US005390890A

United States Patent [19]

Ferguson et al.

[11] Patent Number: 5,390,890

[45] Date of Patent: Feb. 21, 1995

[54] BEACH BLANKET RETAINING DEVICE

[76] Inventors: Lois G. Ferguson; Michael D. Corsi, both of R.R. No. 3, Box 324-D, Greenvalley Rd., Eighty Four, Pa. 15330; Paul M. Doman, 1136 Mike Reed Dr., Library, Pa. 15129

[21] Appl. No.: 121,702

[22] Filed: Sep. 15, 1993

[51] Int. Cl.[6] ..... F16M 13/00

[52] U.S. Cl. ..... 248/545; 248/156; 248/499; 5/417; 135/118; 206/515; 220/339; 220/375

[58] Field of Search ..... 135/118, 119; 5/417, 5/418, 419, 420; 248/508, 499, 545, 156; 141/331, 339; 206/515; 220/375, 339, 380

[56] References Cited

U.S. PATENT DOCUMENTS

| | | | |
|---|---|---|---|
| 2,696,058 | 12/1954 | Beyer . | |
| 2,840,092 | 6/1958 | Hill . | |
| 2,939,468 | 6/1960 | Boyce | 135/118 X |
| 3,017,893 | 1/1962 | Greenbie | 135/118 X |
| 3,080,166 | 3/1963 | Clark . | |
| 3,456,660 | 7/1969 | Borchardt | 135/118 |
| 3,935,653 | 2/1976 | Klein . | |
| 4,599,754 | 7/1986 | Mairs et al. . | |
| 4,634,618 | 1/1987 | Greer et al. . | |
| 4,654,906 | 4/1987 | Roberts . | |
| 4,659,049 | 4/1987 | Watson | 248/156 X |
| 4,709,430 | 12/1987 | Nicoll . | |
| 4,914,767 | 4/1990 | Balicki et al. | 5/417 X |
| 4,927,118 | 5/1990 | Pierorazio | 135/118 X |
| 5,176,354 | 1/1993 | Feigenbaum, Jr. | 248/508 |
| 5,222,703 | 6/1993 | Ricciardelli | 248/156 X |

FOREIGN PATENT DOCUMENTS

| | | | |
|---|---|---|---|
| 1015922 | 8/1977 | Canada | 248/508 |
| 2538868 | 3/1977 | Germany | 135/118 |

*Primary Examiner*—Lanna Mai

*Attorney, Agent, or Firm*—Daniel J. Long

[57] ABSTRACT

A beach blanket retaining device which includes a base spike member which is pointed to allow it to be driven into the ground and which has an upper platform end on which a clamp member for engaging blankets is superimposed. The clamp member is the upper terminal and preferably has a rounded top surface so as to allow it to be used without creating a substantial obstacle to foot traffic.

14 Claims, 4 Drawing Sheets

BEACH BLANKET RETAINING DEVICE

BACKGROUND OF THE INVENTION

The present invention relates to beach blankets, beach towels and the like and, in particular, to devices for securing the same against displacement by the wind.

A number of means have been suggested for preventing beach blankets and towels from being displaced by wind gusts after they are spread on a beach surface.

U.S. Pat. No. 4,634,618, for example, discloses a blanket in which a weighted cord is sewn into its perimeter to hold the blanket in place. U.S. Pat. No. 4,654,906 discloses a beach blanket having a rectangular shape and in each corner has a triangular pocket to receive and hold a quantity of sand for anchoring the blanket. The pockets are closeable to secure the sand therein and openable for discharge of the sand. Such arrangements would appear, however, to require special adaptations in the blankets with which they are used. In the case of the first arrangement, it would appear that additional weight would also have to be carried to the beach.

U.S. Pat. No. 2,840,092 discloses a pin device for retaining blankets and towels on beach surfaces, but that pin would appear to present certain disadvantages in that it has irregular surfaces which protrude to some degree above the beach surface.

SUMMARY OF THE INVENTION

It is, therefore, the object of the present invention to provide a beach blanket retaining device which may be easily transported to the beach; which requires no special adaptation in the beach blankets or towels with which it is used; which may be used without creating obstacle to foot traffic; and which may be easily adapted to present a pleasing ornamental appearance.

This beach blanket retaining device comprises a base spike member adapted by means of a lower pointed end to be driven into a beach surface. The spike member has an upper platform end on which a clamp member is superimposed. The clamp member comprises a lower jaw and an upper jaw which pivots in a vertical arc above the lower jaw to engage the blanket. The clamp member protrudes only unsubstantially above the beach surface, and its upper jaw has a rounded upper surface so that there will be little or no risk that it will be tripped over.

BRIEF DESCRIPTION OF THE DRAWINGS

The beach blanket retaining device of the present invention is further described with reference to the following drawings in which.

DETAILED DESCRIPTION

Figure 2:
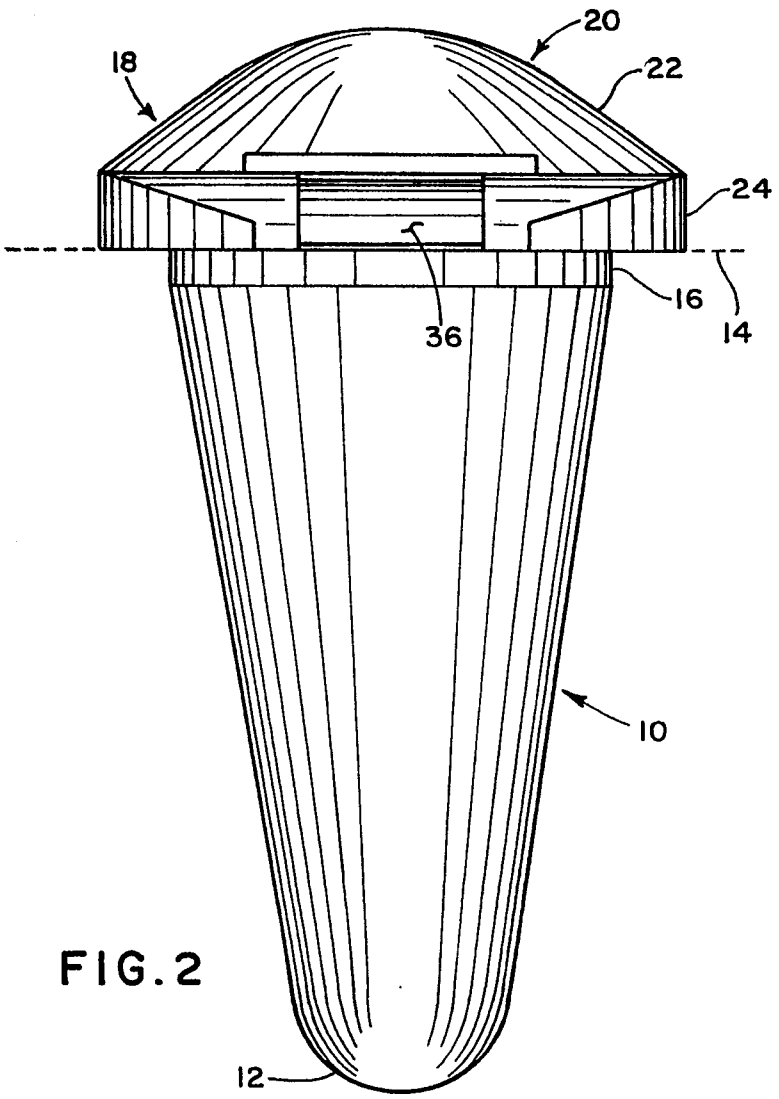
FIG. 2 is a rear elevational view of the device shown in FIG. 1.
Figure 1:
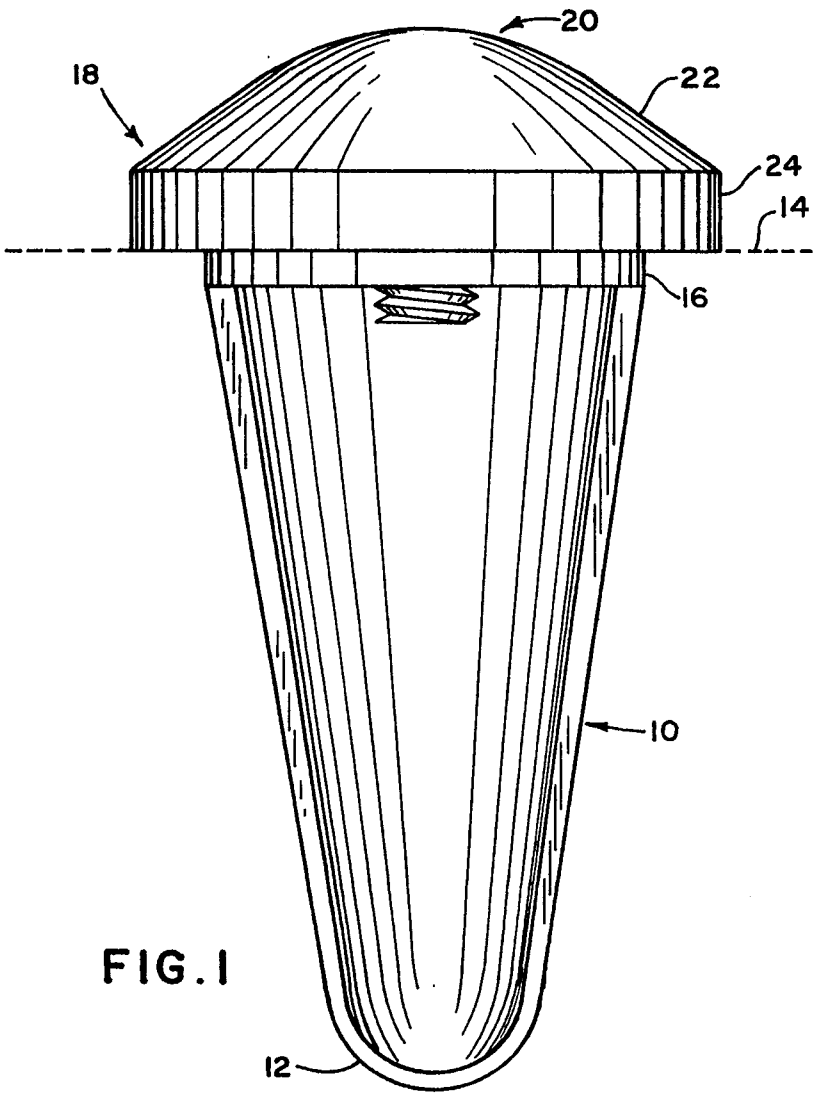
FIG. 1 is front elevational view of the beach blanket retaining device of the present invention.
Figure 4:
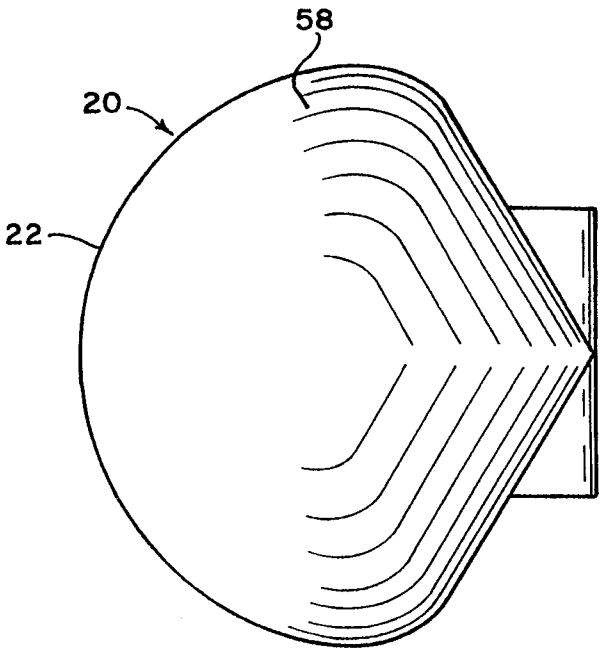
FIG. 4 is a top view of the device shown in FIG. 1.
Figure 3:
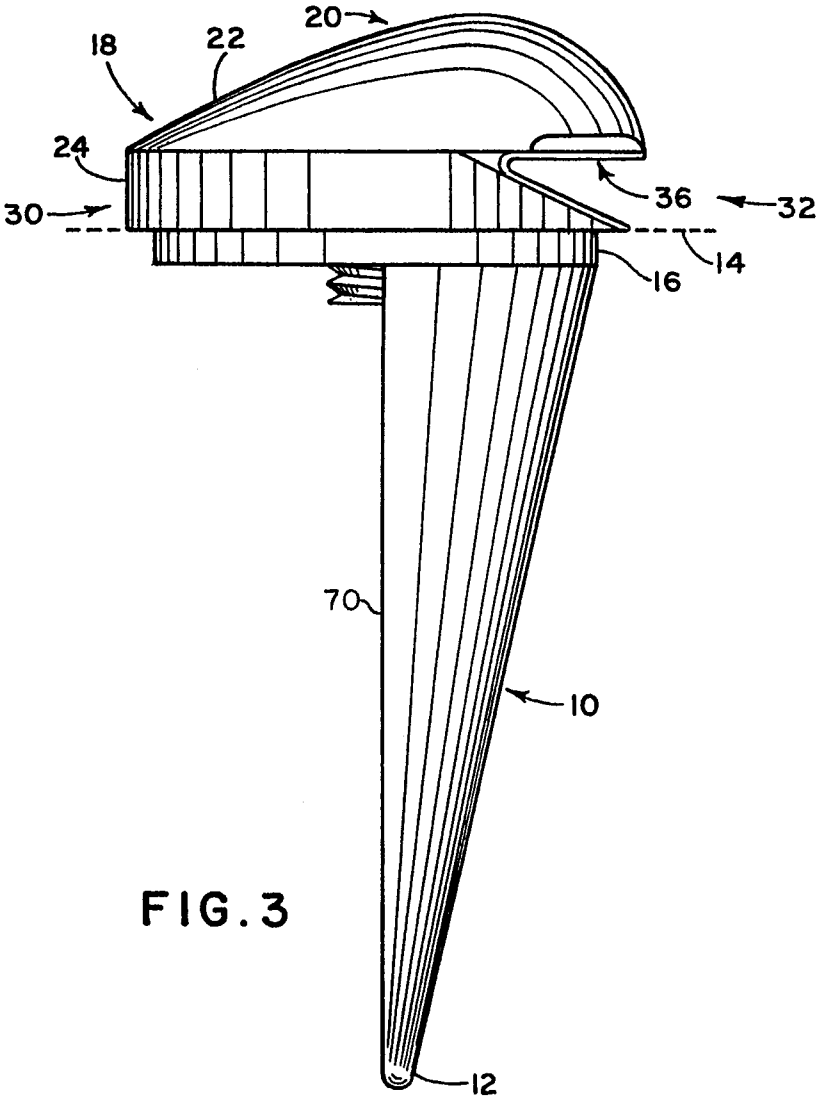
FIG. 3 is a side elevational view of the device shown in FIG. 1.
Figure 6:
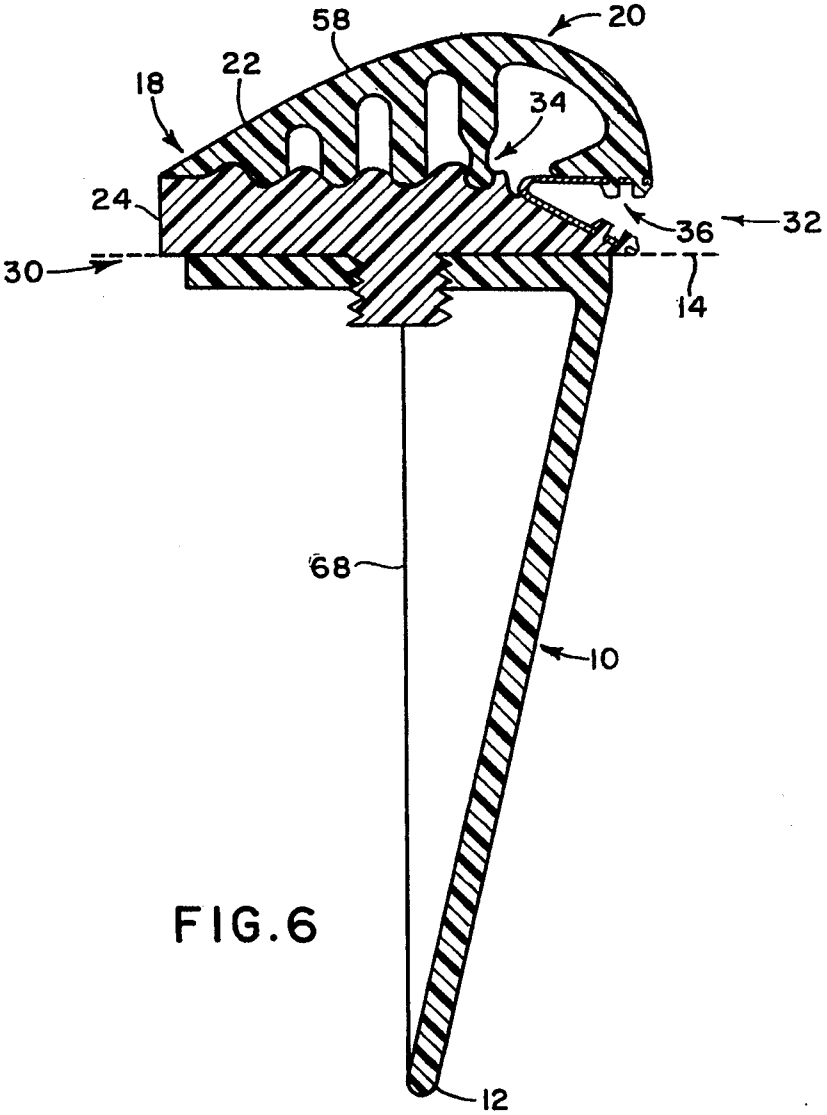
FIG. 6 is a vertical cross sectional view taken through line VI—VI of FIG. 3.
Figure 5:
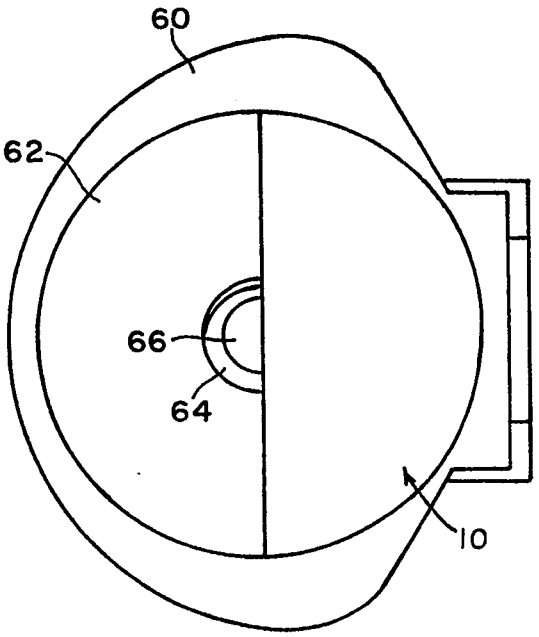
FIG. 5 is a bottom view of the device shown in FIG. 1.
Figure 7:
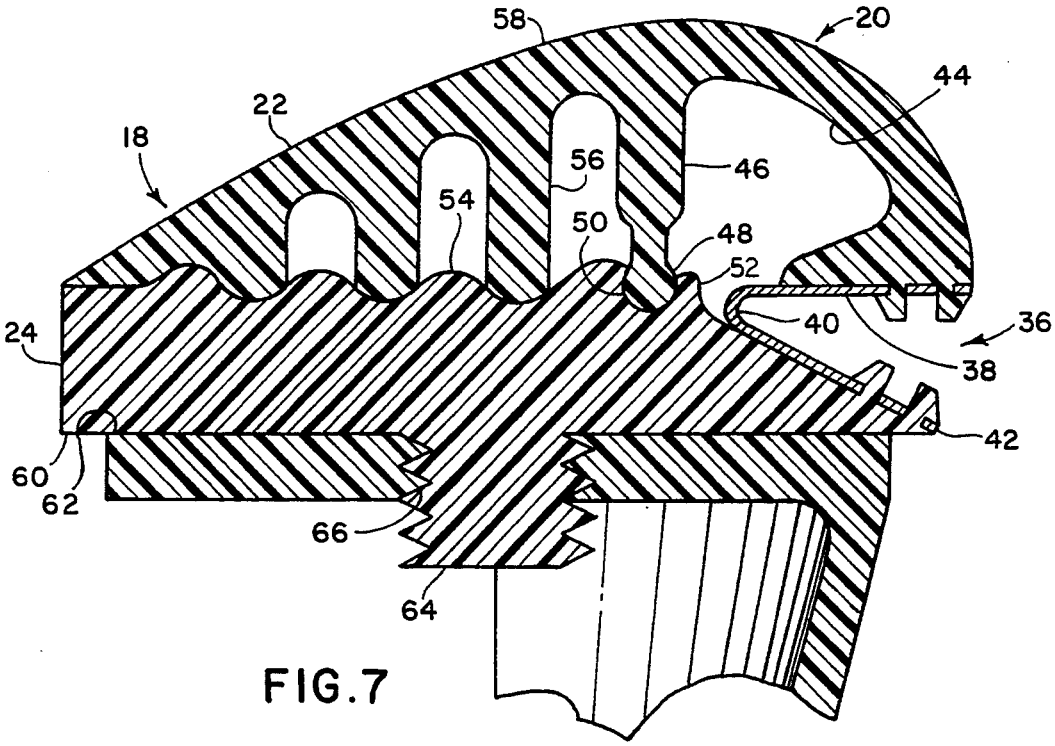
FIG. 7 is a detailed view of the area within circle VII in FIG. 6.

Referring to the drawings, the beach blanket retaining device of the present invention includes a base spike member shown generally at numeral 10. This spike member has a lower pointed end 12 which is adapted to allow the device to be driven into a beach surface as at 14. The spike member also includes an upper platform member 16 on which is superimposed a clamp member shown generally at numeral 18 which forms the upper terminal end 20 of the device.

Figure 8:
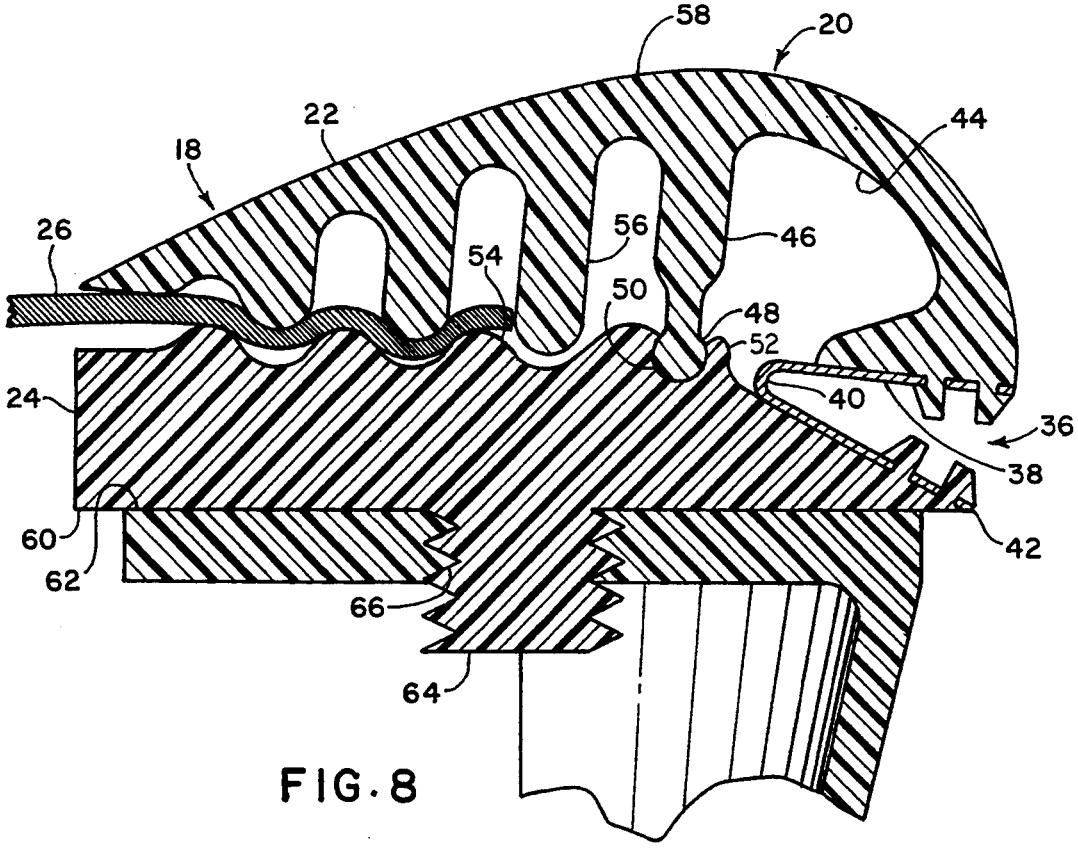
FIG. 8 is a view of the device shown in FIG. 3 in which a beach blanket is engaged by the clamp member.

The clamp member is comprised of an upper jaw 22 and a lower jaw 24. A blanket 26 (FIG. 8) having an edge 28 (FIG. 8) may be retained between the upper and lower jaws of the clamp member. The beach blanket retaining device has a front 30 and rear 32, and positioned medially between the front and rear of the clamp is a pivotal connection point shown generally at 34. A leaf spring shown generally at numeral 36 is positioned rearwardly of the pivotal connection point. The leaf spring has an upper leg 38 which is fixed to the upper jaw, a medial angle 40 and a lower leg 42 which is fixed to the lower jaw. It will be appreciated that when force is applied downwardly on the upper jaw at a position rearwardly of the pivotal connection point then the upper jaw will pivot upwardly from the lower jaw, and when that force is released then the upper jaw will pivot downwardly to engage, for example, a blanket edge between itself and the lower jaw. To further describe the pivotal connection point, the upper jaw has a lower generally concave side 44 from which a vertical projection 46 having a terminal ball 48 extends to engage a socket 50 on the upper side 52 of the lower jaw. There are also a plurality of transverse serrations as at 54 on the upper side of the lower jaw which engage with ribs as at 56 which project downwardly from the lower side of the upper jaw to better secure blankets and the like.

It will also be noted that the upper side 58 of the upper jaw is rounded and may, optionally, be decoratively formed as in the shape of a sea shell, sand dollar, star fish or other such marine wildlife. The clamp member will extend above the beach surface only by a relatively insubstantial amount, preferably by from $\frac{1}{4}$ inches to $3\frac{1}{2}$ inches and more preferably by less than $1\frac{1}{2}$ inches.

The lower jaw has a planar lower side 60 which abuts a planar upper side 62 on the upper platform member of the spike member. From this lower planar side 60 a vertical projection 64 having a peripheral screw thread extends to engage a peripheral screw thread on a central aperture 66 in the upper platform of the spike member. It will also be seen that the spike member also includes two lateral spines 68 and 70 which converge rearwardly to intersect with each other.

It will be appreciated by those skilled in the art that the beach blanket retaining device of the present invention may be used with a plurality of other such devices to engage the edge of a beach blanket at several positions, such as at its corners, so as to secure the blanket against displacement by wind gusts. It will also be appreciated that such beach blanket retaining devices may be used without creating a substantial obstruction even on the most crowded beaches. That is, its construction allows for the secure engagement of blankets while projecting only unsubstantially above the beach surface. At the same time, this construction allows the clamp member to have rounded upper surface. It will also be understood that in using the term "beach blanket" we intend to encompass not only actual blankets of the type used in bedding but also beach towels and any other type of cloth which may be spread on a beach or other ground surface for recreational purposes.

Although the invention has been described with a certain degree of particularity, it is to be understood that the present disclosure has been made only as an example and that the scope of the invention is defined by what is hereafter claimed.

What is claimed is:

1. A beach blanket retaining device comprising:

(a) a base spike member comprising a lower pointed end adapted to be driven into a sandy beach surface and an upper platform end; and (b) a clamp member superimposed on the upper platform end of the base spike member wherein the clamp member comprises an upper jaw and a lower jaw and the upper jaw is pivotable in a vertical arc upwardly from the lower jaw and downwardly therefrom, the clamp member is retained in a closed position with the upper jaw abutting the lower jaw by a spring means, the clamp member has a front end and a rear end and the upper and lower jaws are pivotally connected one to the other at a pivotal connection point positioned medially between said front end, said rear end, a leaf spring is positioned between the upper and lower jaws of the clamp member rearwardly from the pivotal connection point, the leaf spring is V-shaped and has an upper side and a lower side and an angle interposed between said upper side and said lower side and said upper side is fixed to the upper jaw of the clamp member and the lower side is fixed to the lower jaw of the clamp member such that the upper jaw is pivotal in a vertical arc upwardly from the lower jaw when force is applied downwardly on the upper jaw at a point positioned rearwardly of the pivotal connection point, and the upper jaw of the clamp member has a lower concave side from which a leg member having a lower terminal ball projects downwardly to engage a socket on the upper side of the lower jaw member so as to form the pivotal connection point.

2. The beach blanket retaining device of claim 1 wherein the clamp member protrudes only marginally above the sandy beach surface.

3. The beach blanket retaining device of claim 2 wherein the clamp member is adapted to engage a beach blanket.

4. The beach blanket retaining device of claim 3 wherein the beach blanket has an edge and the clamp member is adapted to engage the beach blanket at its edge.

5. The beach blanket retaining device of claim 4 wherein said device is used in conjunction with a plurality of similar devices to retain the beach blanket.

6. The beach blanket retaining device of claim 2 wherein the clamp member protrudes from about $\frac{1}{4}$ inch to about $3\frac{1}{2}$ inches above the sandy beach surface.

7. The beach blanket retaining device of claim 6 wherein the clamp member protrudes less than about $1\frac{1}{2}$ inches above the sandy beach surface.

8. The beach blanket retaining device of claim 1 wherein said beach blanket retaining device has an upper terminal end and the clamp member is positioned at said upper terminal end.

9. The beach blanket retaining device of claim 1 wherein the upper side of the lower jaw member has a plurality of serrations transversely oriented with regard to an axis of the clamp member between its front end and rear end and a plurality of vertical ribs project downwardly from the lower concave side of the upper jaw to engage said serration.

10. The beach blanket retaining device of claim 9 wherein the upper jaw has a rounded upper side.

11. The beach blanket retaining device of claim 10 wherein the upper platform section has an upper planar surface and a central screw threaded aperture.

12. The beach blanket retaining device of claim 11 wherein the lower jaw has a planar lower side which abuts the upper planar side of the upper platform section of the spike member and means are provided to fix said lower jaw to said platform member.

13. The beach blanket retaining device of claim 12 wherein a projection having a peripheral screw thread extends downwardly from the which a central threaded projection extended downwardly to engage the peripheral screw thread of the central aperture in the central aperture in the upper platform section of the spike member.

14. The beach blanket retaining device of claim 10 wherein the spike member had a front end and a rear end and opposed lateral spine members which converge rearwardly with each other.

* * * * *